US007742914B2

(12) United States Patent
Kosek et al.

(10) Patent No.: US 7,742,914 B2
(45) Date of Patent: Jun. 22, 2010

(54) AUDIO SPECTRAL NOISE REDUCTION METHOD AND APPARATUS

(75) Inventors: Daniel A. Kosek, 4055 Kaleigh Ct., Missoula, MT (US) 59803; Robert Crawford Maher, Bozeman, MT (US)

(73) Assignee: Daniel A. Kosek, Missoula, MT (US)

( * ) Notice: Subject to any disclaimer, the term of this patent is extended or adjusted under 35 U.S.C. 154(b) by 1496 days.

(21) Appl. No.: 11/073,820

(22) Filed: Mar. 7, 2005

(65) Prior Publication Data

US 2006/0200344 A1 Sep. 7, 2006

(51) Int. Cl.
*G10L 19/14* (2006.01)

(52) U.S. Cl. ..... 704/205; 704/E21.002; 704/E21.009; 704/E21.01; 704/E19.046; 704/208; 704/E15.006; 704/248

(58) Field of Classification Search ..... 704/E21.002, 704/260, E21.009, E21.01, E19.046, 205, 704/208, E15.006, 248
See application file for complete search history.

(56) References Cited

U.S. PATENT DOCUMENTS 4,074,069 A * 2/1978 Tokura et al. ..... 704/208
4,701,953 A 10/1987 White
4,736,432 A 4/1988 Cantrell
5,377,277 A 12/1994 Bisping
5,432,859 A 7/1995 Yang et al.
5,459,814 A 10/1995 Gupta et al.
5,566,103 A 10/1996 Hyatt
5,615,142 A 3/1997 Hyatt
5,649,055 A 7/1997 Gupta et al.
5,706,395 A 1/1998 Arslan et al.
5,742,694 A 4/1998 Eatwell
5,794,187 A 8/1998 Franklin et al.
5,859,878 A 1/1999 Phillips et al.
5,909,193 A 6/1999 Phillips et al.
5,930,687 A 7/1999 Dapper et al.
5,950,151 A * 9/1999 Bernardini et al. ..... 704/200
5,963,899 A 10/1999 Bayya et al.

(Continued)

OTHER PUBLICATIONS

Drullman, R., Festen, J.M., Plomp, R.,1994. Effect of temporal envelope smearing on speech reception. J. Acoust. Soc. Amer. 95, 1053-1064.*

(Continued)

*Primary Examiner*—Talivaldis I Smits
*Assistant Examiner*—Greg A Borsetti
(74) *Attorney, Agent, or Firm*—Antoinette M. Tease

(57) ABSTRACT

A method of reducing noise in an audio signal, comprising the steps of: using a furrow filter to select spectral components that are narrow in frequency but relatively broad in time; using a bar filter to select spectral components that are broad in frequency but relatively narrow in time; analyzing the relative energy distribution between the output of the furrow and bar filters to determine the optimal proportion of spectral components for the output signal; and reconstructing the audio signal to generate the output signal. A second pair of time-frequency filters may be used to further improve intelligibility of the output signal. The temporal relationship between the furrow filter output and the bar filter output may be monitored so that the fricative components are allowed primarily at boundaries between intervals with no voiced signal present and intervals with voice components. A noise reduction system for an audio signal.

2 Claims, 12 Drawing Sheets

U.S. PATENT DOCUMENTS

| | | | | |
|---|---|---|---|---|
| 6,001,131 | A | 12/1999 | Raman | |
| 6,072,994 | A | 6/2000 | Phillips et al. | |
| 6,091,824 | A | 7/2000 | Lin et al. | |
| 6,097,820 | A | 8/2000 | Turner | |
| 6,115,689 | A * | 9/2000 | Malvar | 704/503 |
| 6,157,908 | A | 12/2000 | O'Gwynn | |
| 6,182,035 | B1 * | 1/2001 | Mekuria | 704/236 |
| 6,249,757 | B1 | 6/2001 | Cason | |
| 6,263,307 | B1 | 7/2001 | Arslan et al. | |
| 6,351,731 | B1 | 2/2002 | Anderson et al. | |
| 6,363,345 | B1 | 3/2002 | Marash et al. | |
| 6,415,253 | B1 | 7/2002 | Johnson | |
| 6,424,942 | B1 | 7/2002 | Mustel et al. | |
| 6,453,285 | B1 | 9/2002 | Anderson et al. | |
| 6,480,610 | B1 | 11/2002 | Fang et al. | |
| 6,493,689 | B2 | 12/2002 | Kotoulas et al. | |
| 6,512,555 | B1 | 1/2003 | Patel et al. | |
| 6,591,234 | B1 | 7/2003 | Chandran et al. | |
| 6,661,837 | B1 | 12/2003 | Abdelilah et al. | |
| 6,661,847 | B1 | 12/2003 | Davis et al. | |
| 6,694,029 | B2 | 2/2004 | Curtis et al. | |
| 6,718,306 | B1 * | 4/2004 | Satoh et al. | 704/246 |
| 6,745,155 | B1 * | 6/2004 | Andringa et al. | 702/189 |
| 6,751,602 | B2 | 6/2004 | Kotoulas et al. | |
| 6,757,395 | B1 | 6/2004 | Fang et al. | |
| 6,804,640 | B1 | 10/2004 | Weintraub et al. | |
| 6,859,540 | B1 | 2/2005 | Takenaka | |
| 6,862,558 | B2 * | 3/2005 | Huang | 702/194 |
| 6,910,011 | B1 * | 6/2005 | Zakarauskas | 704/233 |
| 7,233,899 | B2 * | 6/2007 | Fain et al. | 704/251 |
| 7,243,060 | B2 * | 7/2007 | Atlas et al. | 704/200 |
| 7,574,352 | B2 * | 8/2009 | Quatieri, Jr. | 704/207 |
| 2002/0055839 | A1 * | 5/2002 | Jinnai et al. | 704/240 |
| 2003/0187637 | A1 | 10/2003 | Kang et al. | |
| 2003/0194002 | A1 | 10/2003 | Corless et al. | |
| 2003/0195910 | A1 | 10/2003 | Corless et al. | |
| 2004/0002852 | A1 * | 1/2004 | Kim | 704/205 |
| 2004/0054527 | A1 * | 3/2004 | Quatieri, Jr. | 704/207 |
| 2005/0123150 | A1 * | 6/2005 | Betts | 381/94.3 |
| 2006/0074642 | A1 * | 4/2006 | You | 704/222 |

OTHER PUBLICATIONS

J. L. Shen, J. W. Hung, and L. S. Lee, "Robust entropy-based endpoint detection for speech recognition in noisy environments," presented at the ICSLP, 1998.*

G. Whipple, "Low residual noise speech enhancement utilizing time-frequency filtering," Proc. ICASSP'94, pp. I-5/I-8.*

S. E. Bou-Ghazale and K. Assaleh, "A robust endpoint detection of speech for noisy environments with application to automatic speech recognition," in Proc. IEEE Int. Conf. Acoust. Speech, Signal Process., May 2002, pp. 3808-3811.*

J. J D. Gibson, B. Koo, and S. D. Gray, "Filtering of colored noise for speech enhancement and coding," IEEE Trans. Acoust., Speech, Signal Processing, vol. 39, pp. 1732-1742, 1991.*

A. Drygajlo and B. Carnero, "Integrated speech enhancement and coding in time-frequency domain," in ICASSP'97, (Munich, Germany), pp. 1183-1186, Apr. 1997.*

Kingsbury et al., 1998 B.E.D Kingsbury, N Morgan and S Greenberg, Robust speech recognition using the modulation spectrogram, Speech Communication 25 (1998), pp. 117-132.*

H. Kirchauer, F. Hlawatsch, and W. Kozek, "Time-frequency formulation and design of nonstationaryWiener filters," in Proc. ICASSP, 1995, pp. 1549-1552.*

D.A. Heide, G.S. Kang, Speech enhancement for bandlimited speech, in: Proceedings of the ICASSP, vol. 1, Seattle, WA, USA, May 1998, pp. 393-396.*

Lin and Goubran, 2003 Lin, Z., Goubran, R.A., 2003. Musical noise reduction in speech using two-dimensional spectrogram enhancement. In: Proc. 2nd IEEE Internat. Workshop on Haptic, Audio and Visual Environments and Their Applications, pp. 61-64.*

D.M. Nadeu, and J. Hernando. Time and frequency filtering of filter-bank energies for robust HMM speech recognition, Speech Communication, vol. 34, No. 1-2, pp. 93-114, Apr. 2001.*

T. F. Quatieri and R. B. Dunn, "Speech enhancement based on auditory spectral change," in Proc. IEEE ICASSP, vol. 1, May 2002, pp. 257-260.*

Macho, D., Nadeu, C., Hernando, J., Padrell, J., 1999a. Time and frequency filtering for speech recognition in real noise conditions. In: Proceedings of the Workshop on Robust Methods for Speech Recognition in Adverse Conditions, Tampere, pp. 111-114.*

Kawahara, H., Masuda-Katsuse, I., and de Cheveigné, A. (1999b). "Restructuring speech representations using a pitch-adaptive time-frequency smoothing and an instantaneous-frequency-based F0 extraction: Possible role of a repetitive structure in sounds," Speech Commun. 27, 187-207.*

Steven F. Boll, Suppression of acoustic noise in speech using spectral subtraction, IEEE Transactions on Accoustics, Speech, and Signal processing, Apr. 1, 1979, pp. 113-120, vol. ASSP-27, No. 2., Institute of Electrical and Electronics Engineers, Inc., Piscataway, NJ.

Mark Kahrs, and Karheinz Brandenburg, eds., Applications of Digital Signal Processing to Audio and Acoustics, 1998, Kluwer Academic Publishers Group, Norwell, MA.

Jae S. Lim, and Alan V. Oppenheim, Enhancement and Bandwith Compresion of Noisy Speech., Proceedings of the IEEE, Dec. 1979, pp. 1586-1604, vol. 67, No. 12., Institute of Electrical and Electronics Engineers, Inc., Piscataway, NJ.

Robert C. Maher, A Method for Extrapolation of Missing Digital Audio Data, J. Audio Eng. Soc., May 1994, pp. 350-357, vol. 42, No. 5., Audio Engineering Society, Inc., New York, NY.

Robert C. Maher, Digital Mathods for Noise Removal and Quality Enhancement of Audio Signals, Seminar Presentaion, Creative, Advanced Technology Center Scotts Valley, CA, Apr. 2, pp. 1-194.

Robert J. McAulay and Marilyn L. Malpass, Speech Enhancement Using a Soft-Decision Noise Suppression Filter, IEEE Transactions on Accoustics, Speech, and Signal processing, Apr. 1980, pp. 137-145, vol. ASSP-28, No. 2., Institute of Electrical and Electronics Engineers, Inc., Piscataway, NJ.

L.R. Rabiner, and R.W. Schafer, Digital Processing of Speech Signals, 1978, pp. 1-54, Prentice-Hall, Inc., Englewood Cliffs, NJ.

Pavan K. Ramarapu, and Robert C. Maher, Methods for Reducing Audible Artifacts in a Wavelet-Based Broad-Band Denoising System, J. Audio Eng. Soc., Mar. 1998, pp. 178-189, vol. 46, No. 3., Audio Engineering Society, Inc., New York, NY.

Mark R. Weiss, and Ernest Aschkenasy, Widebamd Speech Enhancement (Addition, Final Tech. Rep, RADC-TR-81-53, DTIC ADA 100462, May 1981, Rome Air Development Center, Griffiss Air Force Base, NY.

* cited by examiner

AUDIO SPECTRAL NOISE REDUCTION METHOD AND APPARATUS

BACKGROUND OF THE INVENTION

1. Field of the Invention

The present invention relates to the field of digital signal processing, and more specifically, to a spectral noise reduction method and apparatus that can be used to remove the noise typically associated with analog signal environments.

2. Description of the Related Art

When an analog signal contains unwanted additive noise, enhancement of the perceived signal-to-noise ratio before playback will produce a more coherent, and therefore more desirable, signal. An enhancement process that is single-ended, that is, one that operates with no information available at the receiver other than the noise-degraded signal itself, is preferable to other methods. The reason it is preferable is because complementary noise reduction schemes, which require cooperation on the part of the broadcaster and the receiver, require both the broadcaster and the receiver to be equipped with encoding and decoding gear, and the encoding and decoding levels must be carefully matched. These considerations are not present with single-ended enhancement processes.

A composite "noisy" signal contains features that are noise and features that are attributable to the desired signal. In order to boost the desired signal while attenuating the background noise, the features of the composite signal that are noise need to be distinguished from the features of the composite signal that are attributable to the desired signal. Next, the features that have been identified as noise need to be removed or reduced from the composite signal. Lastly, the detection and removal methods need to be adjusted to compensate for the expected time-variant behavior of the signal and noise.

Any single-ended enhancement method also needs to address the issue of signal gaps—or "dropouts"—which can occur if the signal is lost momentarily. These gaps can occur when the received signal is lost due to channel interference (for example, lightning, cross-talk, or weak signal) in a radio or transmission or decoding errors in the playback system. The signal enhancement process must detect the signal dropout and take appropriate action, either by muting the playback or by reconstructing an estimate of the missing part of the signal. Although muting the playback does not solve the problem, it is often used because it is inexpensive to implement, and if the gap is very short, it may be relatively inaudible.

Several single-ended methods of reducing the audibility of unwanted additive noise in analog signals have already been developed. These methods generally fall into two categories: time-domain level detectors and frequency-domain filters. Both of these methods are one-dimensional in the sense that they are based on either the signal waveform (amplitude) as a function of time or the signal's frequency content at a particular time. By contrast, and as explained more fully below in the Detailed Description of Invention section, the present invention is two-dimensional in that it takes into consideration how both the amplitude and frequency content change with time.

Accordingly, it is an object of the present invention to devise a process for improving the signal-to-noise ratio in audio signals. It is a further object of the present invention to develop an intelligent model for the desired signal that allows a substantially more effective separation of the noise and the desired signal than current single-ended processes. The one-dimensional (or single-ended) processes used in the prior art are described more fully below, as are the discrete Fourier transform and Fourier transform magnitude—two techniques that play a role in the present invention.

A. Time-Domain Level Detection

The time-domain method of noise elimination or reduction uses a specified signal level, or threshold, that indicates the likely presence of the desired signal. The threshold is set (usually manually) high enough so that when the desired signal is absent (for example, when there is a pause between sentences or messages), there is no hard hiss. The threshold, however, must not be set so high that the desired signal is affected when it is present. If the received signal is below the threshold, it is presumed to contain only noise, and the output signal level is reduced or "gated" accordingly. As used in this context, the term "gated" means that the signal is not allowed to pass through. This process can make the received signal sound somewhat less noisy because the hiss goes away during the pause between words or sentences, but it is not particularly effective. By continuously monitoring the input signal level as compared to the threshold level, the time-domain level detection method gates the output signal on and off as the input signal level varies. These time-domain level detection systems have been variously referred to as squelch control, dynamic range expander, and noise gate.

In simple terms, the noise gate method uses the amplitude of the signal as the primary indicator: if the input signal level is high, it is assumed to be dominated by the desired signal, and the input is passed to the output essentially unchanged. On the other hand, if the received signal level is low, it is assumed to be a segment without the desired signal, and the gain (or volume) is reduced to make the output signal even quieter.

The difference between the time-domain methods and the present invention is that the time-domain methods do not remove the noise when the desired signal is present. Instead, if the noisy signal exceeds the threshold, the gate is opened, and the signal is allowed to pass through. Thus, the gate may open if there is a sudden burst of noise, a click, or some other loud sound that causes the signal level to exceed the threshold. In that case, the output signal quality is good only if the signal is sufficiently strong to mask the presence of the noise. For that reason, this method only works if the signal-to-noise ratio is high.

The time-domain method can be effective if the noisy input consists of a relatively constant background noise and a signal with a time-varying amplitude envelope (i.e., if the desired signal varies between loud and soft, as in human speech). Changing the gain between the "pass" (or open) mode and the "gate" (or closed) mode can cause audible noise modulation, which is also called "gain pumping." The term "gain pumping" is used by recording engineers and refers to the audible sound of the noise appearing when the gate opens and then disappearing when the gate closes. Furthermore, the "pass" mode simply allows the signal to pass but does not actually improve the signal-to-noise ratio when the desired signal is present.

The effectiveness of the time-domain detection methods can be improved by carefully controlling the attack and release times (i.e., how rapidly the circuitry responds to changes in the input signal) of the gate, causing the threshold to vary automatically if the noise level changes, and splitting the gating decision into two or more frequency bands. Making the attack and release times somewhat gradual will lessen the audibility of the gain pumping, but it does not completely solve the problem. Multiple frequency bands with individual gates means that the threshold can be set more optimally if the noise varies from one frequency band to another. For example, if the noise is mostly a low frequency hum, the threshold can be set high enough to remove the noise in the low frequency band while still maintaining a lower threshold in the high frequency ranges. Despite these improvements, the time-domain detection method is still limited as compared to the present invention because the noise gate cannot distinguish between noise and the desired signal, other than on the basis of absolute signal level.

FIG. 1 is a flow diagram of the noise gate process. As shown in this figure, the noisy input 10 passes through a level detector 20 and then to a comparator 30, which compares the frequency level of the noisy input 10 to a pre-set threshold 40. If the frequency level of the noisy input 10 is greater than the threshold 40, then it is presumed to be a desired signal, the signal is passed through the gain-controlled amplifier (or gate) 50, and the gain is increased to make the output signal 60 even louder. If the frequency level of the noisy input 10 is less than the threshold 40, then it is presumed to constitute noise, and the signal is passed to the gain-controlled amplifier 50, where the gain is decreased to make the output signal 60 even quieter. If the signal is below the threshold level, it does not pass through the gate.

B. Frequency-Domain Filtration

The other well-known procedure for signal enhancement involves the use of spectral subtraction in the frequency domain. The goal is to make an estimate of the noise power as a function of frequency, then subtract this noise spectrum from the input signal spectrum, presumably leaving the desired signal spectrum.

For example, consider the signal spectrum shown in FIG. 2. The graph shows the amplitude, or signal energy, as a function of frequency. This example spectrum is harmonic, which means that the energy is concentrated at a series of discrete frequencies that are integer multiples of a base frequency (also called a "fundamental"). In this example, the fundamental is 100 Hz; therefore, the energy consists of harmonic partials, or harmonic overtones, at 100, 200, 300, etc. Hz. A signal with a harmonic spectrum has a specific pitch, or musical tone, to the human ear.

The example signal of FIG. 2 is intended to represent the clean, noise-free original signal, which is then passed through a noisy radio channel. An example of the noise spectrum that could be added by a noisy radio channel is shown in FIG. 3. Note that unlike the discrete frequency components of the harmonic signal, the noise signal in FIG. 3 has a more uniform spread of signal energy across the entire frequency range. The noise is not harmonic, and it sounds like a hiss to the human ear. If the desired signal of FIG. 2 is now sent through a channel containing additive noise distributed as shown in FIG. 3, the resulting noisy signal that is received is shown in FIG. 4, where the dashed line indicates the noise level.

In a prior art spectral subtraction system, the receiver estimates the noise level as a function of frequency. The noise level estimate is usually obtained during a "quiet" section of the signal, such as a pause between spoken words in a speech signal. The spectral subtraction process involves subtracting the noise level estimate, or threshold, from the received signal so that any spectral energy that is below the threshold is removed. The noise-reduced output signal is then reconstructed from this subtracted spectrum.

An example of the noise-reduced output spectrum for the noisy signal of FIG. 4 is shown in FIG. 5. Note that because some of the desired signal spectral components were below the noise threshold, the spectral subtraction process inadvertently removes them. Nevertheless, the spectral subtraction method can conceivably improve the signal-to-noise ratio if the noise level is not too high.

The spectral subtraction process can cause various audible problems, especially when the actual noise level differs from the estimated noise spectrum. In this situation, the noise is not perfectly canceled, and the residual noise can take on a whistling, tinkling quality sometimes referred to as "musical noise" or "birdie noise." Furthermore, spectral subtraction does not adequately deal with changes in the desired signal over time, or the fact that the noise itself will generally fluctuate rapidly from time to time. If some signal components are below the noise threshold at one instant in time but then peak above the noise threshold at a later instant in time, the abrupt change in those components can result in an annoying audible burble or gargle sound.

Some prior art improvements to the spectral subtraction method have been made, such as frequently updating the noise level estimate, switching off the subtraction in strong signal conditions, and attempting to detect and suppress the residual musical noise. None of these techniques, however, has been wholly successful at eliminating the audible problems.

C. Discrete Fourier Transform and Fourier Transform Magnitude

The discrete Fourier transform ("DFT") is a computational method for representing a discrete-time ("sampled" or "digitized") signal in terms of its frequency content. A short segment (or "data frame") of an input signal, such as a noisy audio signal treated in this invention, is processed according to the well-known DFT analysis formula (1):

$$X[k] = \sum_{n=0}^{N-1} x[n]\, e^{-j2\pi nk/N}$$

where N is the length of the data frame, x[n] are the N digital samples comprising the input data frame, X[k] are the N Fourier transform values, j represents the mathematical imaginary quantity (square-root of −1), e is the base of the natural logarithms, and $e^{j\theta}=\cos(\theta)+j\cdot\sin(\theta)$, which is the relationship known as Euler's formula.

The DFT analysis formula expressed in equation (1) can be interpreted as producing N equally-spaced samples between zero and the digital sampling frequency for the signal x[n]. Because the DFT formula involves the imaginary number j, the X[k] spectral samples will, in general, be mathematically complex numbers, meaning that they will have a "real" part and an "imaginary" part.

The inverse DFT is computed using the standard inverse transform, or "Fourier synthesis" equation (2):

$$x[n] = \sum_{k=0}^{N-1} X[k]\, e^{+j2\pi nk/N}$$

Equation 2 shows that the data frame x[n] can be reconstructed, or synthesized, from the DFT data X[k] without any loss of information: the signal can be reconstructed from its Fourier transform, at least within the limits of numerical precision. This ability to reconstruct the signal from its Fourier transform allows the signal to be converted from the discrete-time domain to the frequency domain (Fourier) and vice versa.

In order to estimate the signal power in a particular range of frequencies, such as when attempting to distinguish between the background noise and the desired signal, this information can be obtained by calculating the spectral magnitude of the DFT by the standard Pythagorean formula (3):

$$\text{magnitude} = |X[k]| = \sqrt{\{Re(X[k])\}^2 + \{Im(X[k])\}^2}$$

where Re( ) and Im( ) indicate taking the mathematical real part and imaginary part, respectively. Although the input signal x[n] cannot, in general, be reconstructed from the DFT magnitude, the magnitude information can be used to find the distribution of signal power as a function of frequency for that particular data frame.

BRIEF SUMMARY OF THE INVENTION

The present invention covers a method of reducing noise in an audio signal, wherein the audio signal comprises spectral components, comprising the steps of: using a furrow filter to select spectral components that are narrow in frequency but relatively broad in time; using a bar filter to select spectral components that are broad in frequency but relatively narrow in time; wherein there is a relative energy distribution between the output of the furrow and bar filters, analyzing the relative energy distribution between the output of the furrow and bar filters to determine the proportion of spectral components selected by each filter that will be included in an output signal; and reconstructing the audio signal based on the analysis above to generate the output signal. The furrow filter is used to identify discrete spectral partials, as found in voiced speech and other quasi-periodic signals. The bar filter is used to identify plosive and fricative consonants found in speech signals. The output signal that is generated as a result of the method of the present invention comprises less broadband noise than the initial audio signal. In the preferred embodiment, the audio signal is reconstructed using overlapping inverse Fourier transforms.

An optional enhancement to the method of the present invention includes the use of a second pair of time-frequency filters to improve intelligibility of the output signal. More specifically, this second pair of time-frequency filters is used to obtain a rapid transition from a steady-state voiced speech segment to adjacent fricatives or gaps in speech without temporal smearing of the audio signal. The first pair of time-frequency filters described in connection with the main embodiment of the present invention is referred to as the "long-time" filters, and the second pair of time-frequency filters that is included in the enhancement is referred to as the "short-time" filters. The long-time filters tend not to respond as rapidly as the short-time filters to input signal changes, and they are used to enhance the voiced features of a speech segment. The short-time filters do respond rapidly to input signal changes, and they are used to locate where new words start. Transient monitoring is used to detect sudden changes in the input signal, and resolution switching is used to change from the short-time filters to the long-time filters and vice versa.

Each pair of filters (both short-time and long-time) comprise a furrow filter and a bar filter, and another optional enhancement to the method of the present invention includes monitoring the temporal relationship between the furrow filter output and the bar filter output so that the fricative components are allowed primarily at boundaries between intervals with no voiced signal present and intervals with voice components. This monitoring ensures that the fricative phoneme(s) of the speech segment is/are not mistaken for undesired additive noise.

In an alternate embodiment, the present invention covers a method of reducing noise in an audio signal, wherein the audio signal comprises spectral components, comprising the steps of: segmenting the audio signal into a plurality of overlapping data frames; multiplying each data frame by a smoothly tapered window function; computing the Fourier transform magnitude for each data frame; and comparing the resulting spectral data for each data frame to the spectral data of the prior and subsequent frames to determine if the data frame contains predominantly coherent or predominantly random material. The predominantly coherent material is indicated by the presence of distinct characteristic features in the Fourier transform magnitude, such as discrete harmonic partials or other repetitive structure. The predominantly random material, on the other hand, is indicated by a spread of spectral energy across all frequencies. Furthermore, the criteria used to compare the resulting spectral data for each frame are consistently applied from one frame to the next in order to emphasize the spectral components of the audio signal that are consistent over time and de-emphasize the spectral components of the audio signal that vary randomly over time.

The present invention also covers a noise reduction system for an audio signal comprising a furrow filter and a bar filter, wherein the furrow filter is used to select spectral components that are narrow in frequency but relatively broad in time, and the bar filter is used to select spectral components that are broad in frequency but relatively narrow in time, wherein there is a relative energy distribution between the output of the furrow and bar filters, and said relative energy distribution is analyzed to determine the proportion of spectral components selected by each filter that will be included in an output signal, and wherein the audio signal is reconstructed based on the analysis of the relative energy distribution between the output of the furrow and bar filters to generate the output signal. As with the method claims, the furrow filter is used to identify discrete spectral partials, as found in voiced speech and other quasi-periodic signals, and the bar filter is used to identify plosive and fricative consonants found in speech signals. The output signal that exits the system comprises less broadband noise than the audio signal that enters the system. In the preferred embodiment, the audio signal is reconstructed using overlapping inverse Fourier transforms.

An optional enhancement to the system of the present invention further comprises a second pair of time-frequency filters, which are used to improve intelligibility of the output signal. As stated above, this second pair of time-frequency filters is used to obtain a rapid transition from a steady-state voiced speech segment to adjacent fricatives or gaps in speech without temporal smearing of the audio signal. As with the method claims, the second pair of "short-time" filters responds rapidly to input signal changes and is used to locate where new words start. The first pair of "long-time" filters tends not to respond as rapidly as the short-time filters to input signal changes, and they are used to enhance the voiced features of a speech segment. Transient monitoring is used to detect sudden changes in the input signal, and resolution switching is used to change from the short-time filters to the long-time filters and vice versa.

Another optional enhancement to the system of the present invention, wherein each pair of filters comprises a furrow filter and a bar filter, includes monitoring the temporal relationship between the furrow filter output and the bar filter output so that the fricative components are allowed primarily at boundaries between intervals with no voiced signal present and intervals with voice components. As stated above, this monitoring ensures that the fricative phoneme(s) of the speech segment is/are not mistaken for undesired additive noise.

REFERENCE NUMBERS

Figure 1:
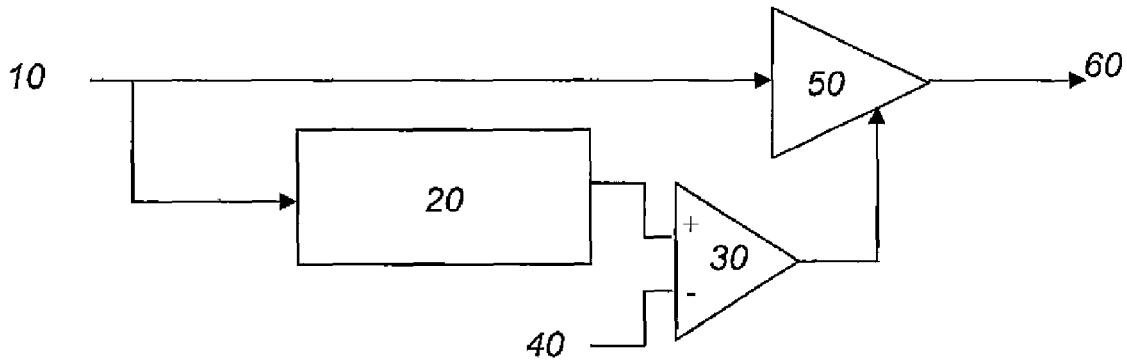
PRIOR ART Figure 1
FIG. 1 is a flow diagram of the noise gate process.
Figure 2:
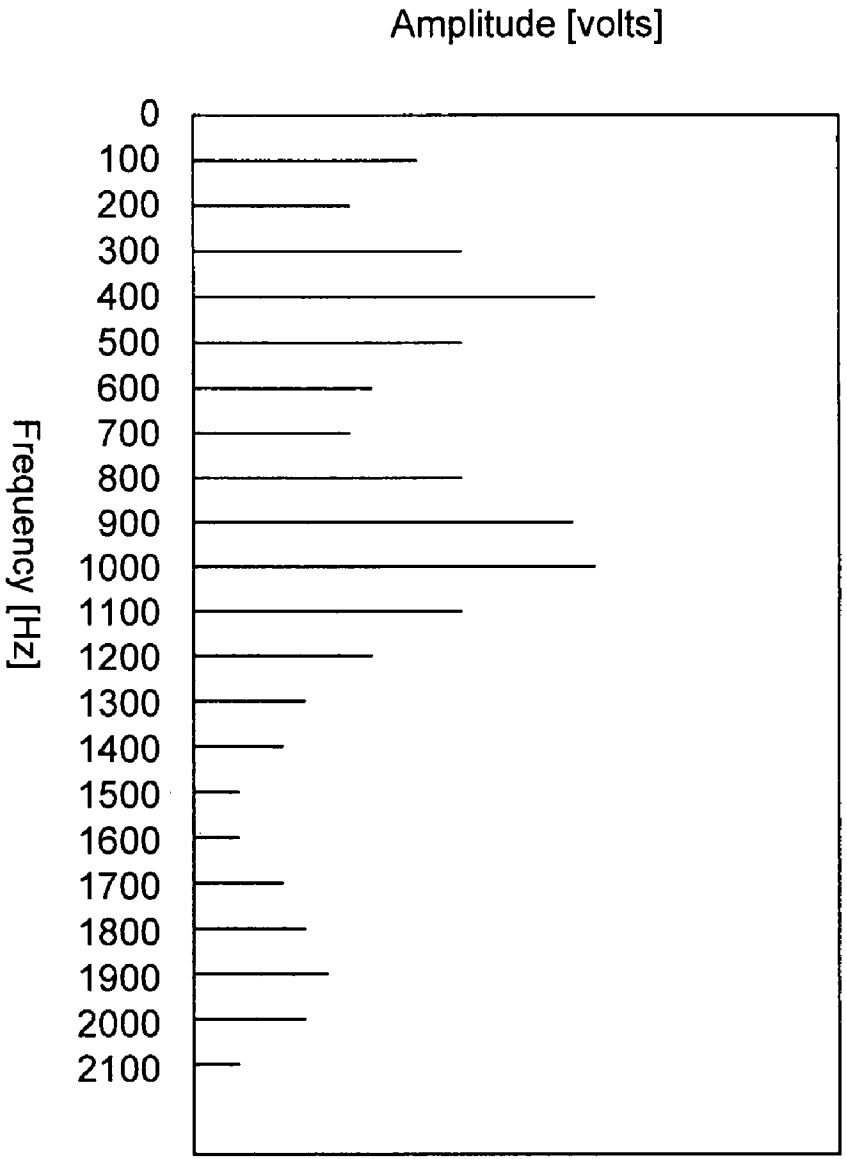
FIG. 2 is a signal spectrum graph showing a desired signal.
Figure 3:
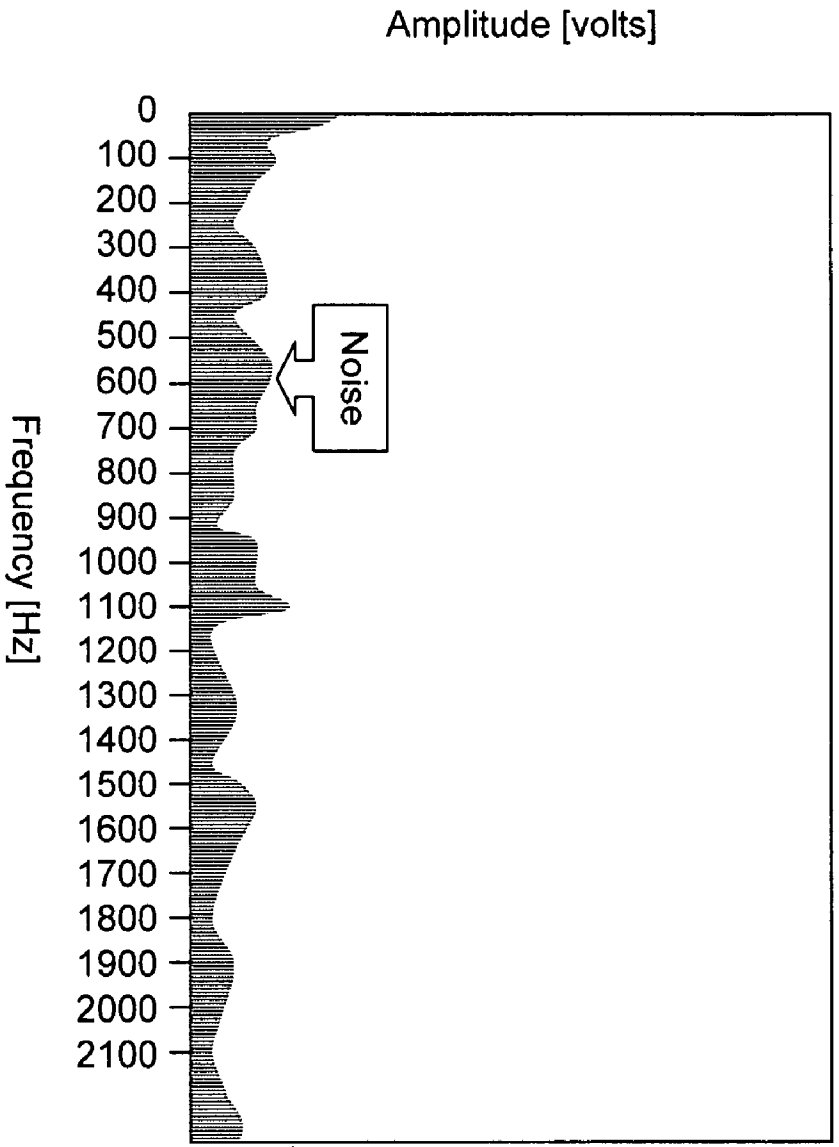
FIG. 3 is a noise distribution graph showing noise only.
Figure 4:
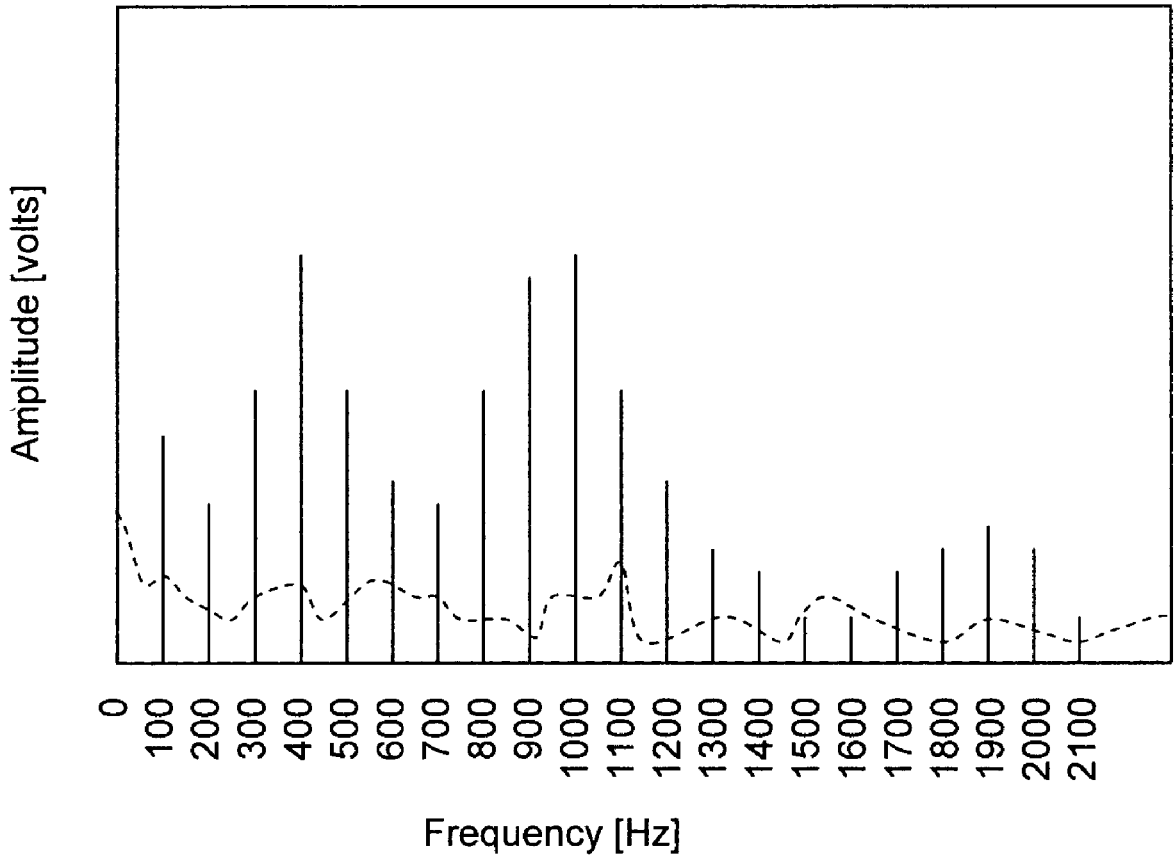
FIG. 4 is a graph showing the resulting noisy signal when the desired signal of FIG. 2 is combined with the noise of FIG. 3.
Figure 5:
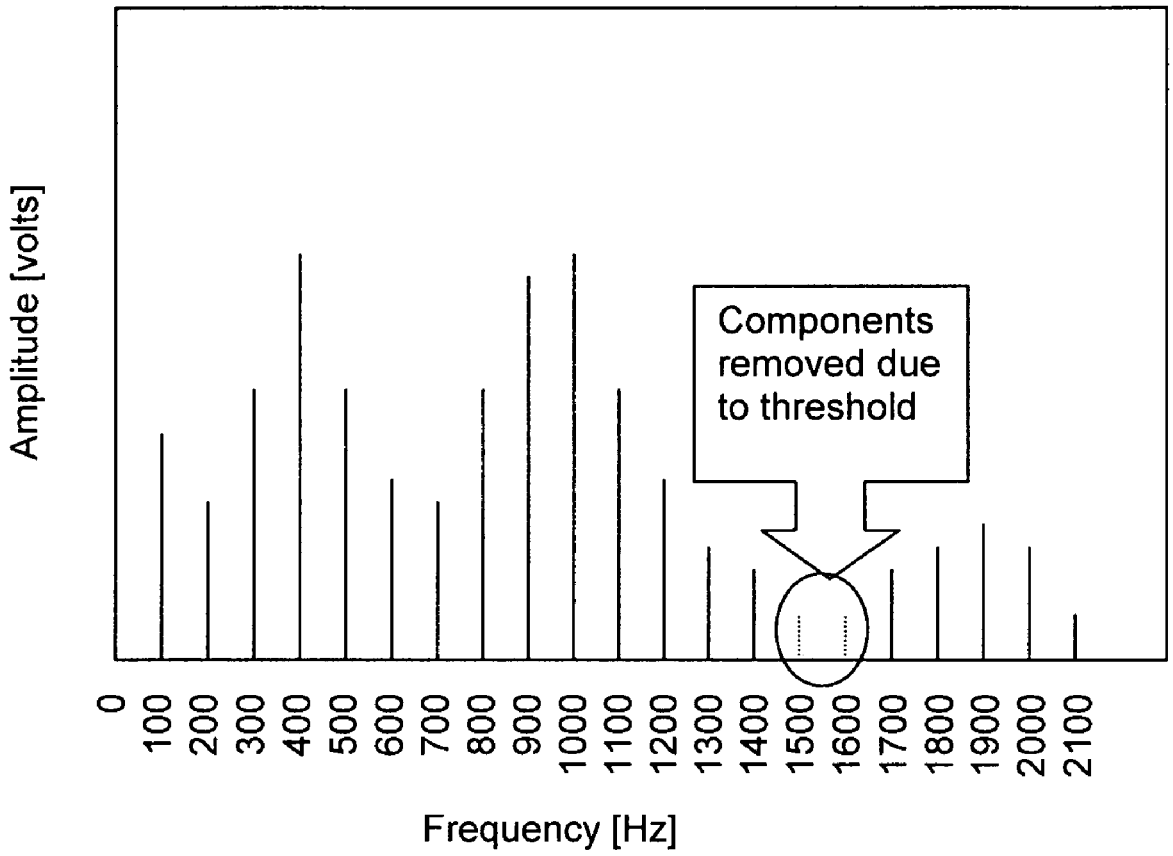
FIG. 5 is a graph showing the noise-reduced output spectrum for the noisy signal shown in FIG. 4.

10 Noisy input signal
20 Level detector
30 Comparator
40 Threshold
50 Gain-controlled amplifier
60 Output signal
70 Furrow filter
80 Bar filter
100 Overlapping blocks
110 Tapered window function
120 Fast Fourier transform
130 Blocks of raw FFT data
140 Queue (blocks of raw FFT data)
150 Magnitude computation
160 Long furrow filter
170 Short furrow filter
180 Short bar filter
190 Long bar filter
200 Queue (magnitude blocks)
210 Evaluation
220 Weighting calculation
230 Filtered two-dimensional data (from long furrow)
240 Filtered two-dimensional data (from short furrow)
250 Filtered two-dimensional data (from short bar)
260 Filtered two-dimensional data (from long bar)
270 Mixing control weight (long furrow)
280 Mixing control weight (short furrow)
290 Mixing control weight (short bar)
300 Mixing control weight (long bar)
310 Multiplier (long furrow)
320 Multiplier (short furrow)
330 Multiplier (short bar)
340 Multiplier (long bar)
350 Summer
360 Filtered output FFT data
370 Inverse FFT
380 FFT overlap and add
390 Noise-reduced output signal
400 Analog signal source
410 Analog-to-digital converter
420 Digital signal processor or microprocessor
430 Digital-to-analog converter
440 Noise-reduced analog signal

DETAILED DESCRIPTION OF INVENTION

The current state of the art with respect to noise reduction in analog signals involves the combination of the basic features of the noise gate concept with the frequency-dependent filtering of the spectral subtraction concept. Even this method, however, does not provide a reliable means to retain the desired signal components while suppressing the undesired noise. The key factor that has been missing from prior techniques is a means to distinguish between the coherent behavior of the desired signal components and the incoherent behavior of the additive noise. The present invention involves performing a time-variant spectral analysis of the incoming noisy signal, identifying features that behave consistently over a short-time window, and attenuating or removing features that exhibit random or inconsistent fluctuations.

The method employed in the present invention includes a data-adaptive, multi-dimensional (frequency, amplitude and time) filter structure that works to enhance spectral components that are narrow in frequency but relatively long in time, while reducing signal components (noise) that exhibit neither frequency nor temporal correlation. The effectiveness of this approach is due to its ability to distinguish the quasi-harmonic characteristics and the short-in-time but broad-in-frequency content of fricative sounds found in typical signals such as speech and music from the uncorrelated time-frequency behavior of broadband noise.

The major features of the signal enhancement method of the present invention include:

(1) implementing broadband noise reduction as a set of two-dimensional (2-D) filters in the time-frequency domain;

(2) using multiple time-frequency resolutions in parallel to match the processing resolution to the time-variant signal characteristics; and (3) for speech signals, improving intelligibility through explicit treatment of the voiced-to-silence, voiced-to-unvoiced, unvoiced-to-voiced, and silence-to-voiced transitions.

Each of these features is discussed more fully below.

A. Basic Method: Reducing Noise Through the Use of Two-Dimensional Filters in the Time-Frequency Domain The present invention entails a time-frequency orientation in which two separate 2-D (time vs. frequency) filters are constructed. One filter, referred to as a "furrow" filter, is designed so that it preferentially selects spectral components that are narrow in frequency but relatively broad in time (corresponding to discrete spectral partials, as found in voiced speech and other quasi-periodic signals). The other 2-D filter, referred to as a "bar" filter, is designed to pass spectral components that are broad in frequency but relatively narrow in time (corresponding to plosive and fricative consonants found in speech signals). The relative energy distribution between the output of the furrow and bar 2-D filters is used to determine the proportion of these constituents in the overall output signal. The broadband noise, lacking a coordinated time-frequency structure, is therefore reduced in the composite output signal.

In the case of single-ended noise reduction, the received signal s(t) is assumed to be the sum of the desired signal d(t) and the undesired noise n(t): s(t)=d(t)+n(t). Because only the received signal s(t) can be observed, the above equation is analogous to a+b=5, one equation with two unknowns. Thus, it is not possible to solve the equation using a simple mathematical solution. Instead, a reasonable estimate has to be made as to which signal features are most likely to be attributed to the desired portion of the received signal and which signal features are most likely to be attributed to the noise. In the present invention, the novel concept is to treat the signal as a time-variant spectrum and use the consistency of the frequency versus time information to separate out what is desired signal and what is noise. The desired signal components are the portions of the signal spectrum that tend to be narrow in frequency and long in time.

In the present invention, the furrow and bar filters are used to distinguish between the coherent signal, which is indicated by the presence of connected horizontal tracks on a spectrogram (with frequency on the vertical axis and time on the horizontal axis), and the unwanted broadband noise, which is indicated by the presence of indistinct spectral features. The furrow filter emphasizes features in the frequency vs. time spectrum that exhibit the coherent property, whereas the bar filter emphasizes features in the frequency vs. time spectrum that exhibit the fricative property of being short in time but broad in frequency. The background noise, being both broad in frequency and time, is minimized by both the furrow and bar filters.

There is a fundamental signal processing tradeoff between resolution in the time dimension and resolution in the frequency dimension. Obtaining very narrow frequency resolution is accomplished at the expense of relatively poor time resolution, and conversely, obtaining very short time resolution can only be accomplished with broad frequency resolution. In other words, this fundamental mathematical uncertainty principle dictates that the tradeoff cannot be used to create a set of filters that offer a variety of time and frequency resolutions.

The 2-D filters of the present invention are placed systematically over the entire frequency vs. time spectrogram, the signal spectrogram is observed through the frequency vs. time region specified by the filter, and the signal spectral components with the filter's frequency vs. time resolution are summed. This process emphasizes features in the signal spectrum that are similar to the filter in frequency vs. time, while minimizing signal spectral components that do not match the frequency vs. time shape of the filter.

Figure 6:
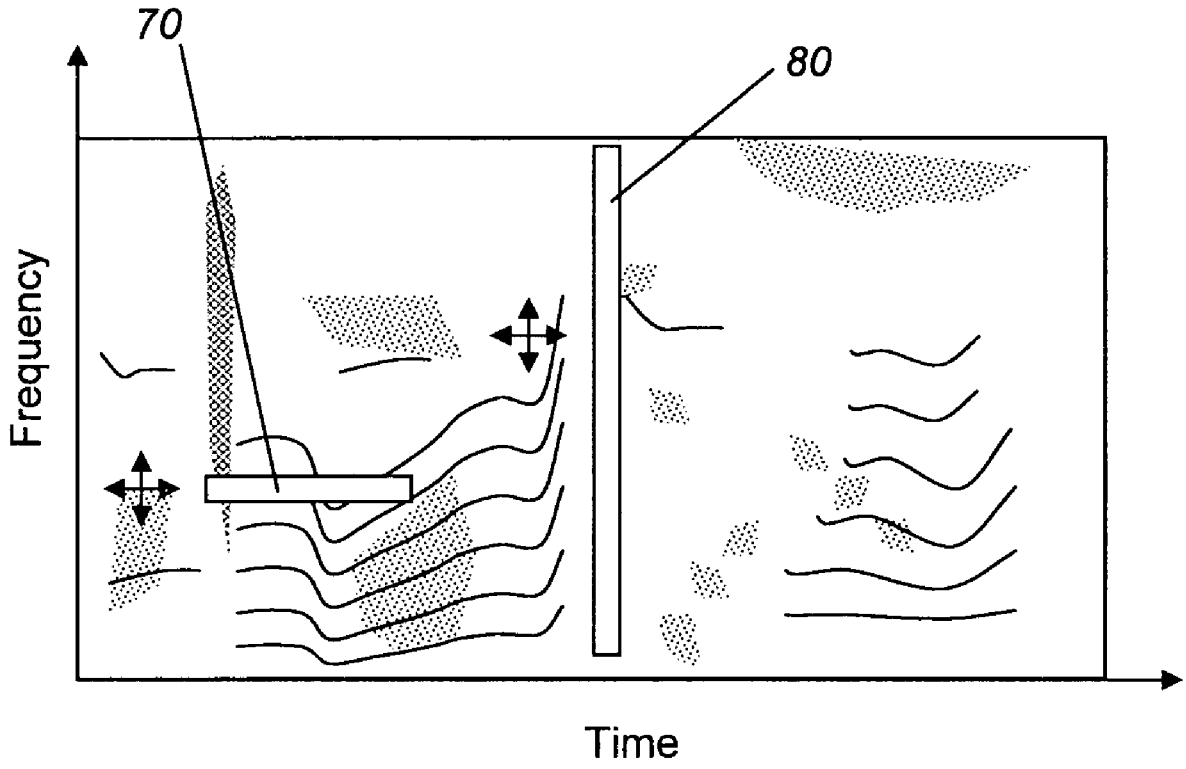
FIG. 6 is a diagram of the two-dimensional filter concept of the present invention.

This 2-D filter arrangement is depicted in FIG. 6. In this figure, both the furrow filter 70 and the bar filter 80 are convolved over the entire time-frequency space, which means that the filter processes the 2-D signal data and emphasizes the features in the frequency vs. time data that match the shape of the filter, while minimizing the features of the signal that do not match. The furrow and bar filters of the present invention each perform a separate function. As noted above, the furrow filter keeps the signal components that are narrow in frequency and long in time. There are, however, important speech sounds that do not fit those criteria. Specifically, the consonant sounds like "k," "t," "sh" and "b" are unvoiced, which means that the sound is produced by pushing air around small gaps formed between the tongue, lips and teeth rather than using the pitched sound from the vocal cords. The unvoiced sounds tend to be the opposite of the voiced sounds, that is, the consonants are short in time but broad in frequency. The bar filter is used to enhance these unvoiced sounds. Because the unvoiced sounds of speech tend to be at the beginning or end of a word, the bar filter tends to be effective at the beginning and/or end of a segment in which the furrow filter has been utilized.

In an alternate embodiment, the furrow and bar structures are not implemented as 2-D digital filters; instead, a frame-by-frame analysis and recursive testing procedure can also be used in order to minimize the computation rate. In this alternate embodiment, the noisy input signal is segmented into a plurality of overlapping data frames. Each frame is multiplied by a smoothly tapered window function, the Fourier transform magnitude (the spectrum) for the frame is computed, and the resulting spectral data for that frame is examined and compared to the spectral data of the prior frame and the subsequent frame to determine if that portion of the input signal contains predominantly coherent material or predominantly random material.

The resulting collection of signal analysis data can be viewed as a spectrogram: a representation of signal power as a function of frequency on the vertical axis and time on the horizontal axis. Spectral features that are coherent appear as connected horizontal lines, or tracks, when viewed in this format. Spectral features that are due to broadband noise appear as indistinct spectral components that are spread more or less uniformly over the time vs. frequency space. Spectral features that are likely to be fricative components of speech are concentrated in relatively short time intervals but relatively broad frequency ranges that are typically correlated with the beginning or the end of a coherent signal segment, such as would be caused by the presence of voiced speech components.

In this alternate embodiment, the criteria applied to select the spectral features are retained from one frame to the next in order to accomplish the same goal as the furrow and bar 2-D filters, namely, the ability to emphasize the components of the signal spectrum that are consistent over time and de-emphasize the components that vary randomly from one moment to the next.

B. First Optional Enhancement: Using Parallel Filter Sets to Match the Processing Resolution to the Time-Variant Signal Characteristics To further enhance the effectiveness of the present invention, a second pair of time-frequency filters may be used in addition to the furrow and bar filter pair described above. The latter pair of filters are "long-time" filters, whereas the former (or second) pair of filters are "short-time" filters. A short-time filter is one that will accept sudden changes in time. A long-time filter, on the other hand, is one that tends to reject sudden changes in time. This difference in filter behavior is attributable to the fact that there is a fundamental trade-off in signal processing between time resolution and frequency resolution. Thus, a filter that is very selective (narrow) in frequency will need a long time to respond to an input signal. For example, a very short blip in the input will not be enough to get a measurable signal in the output of such a filter. Conversely, a filter that responds to rapid input signal changes will need to be broader in its frequency resolution so that its output can change rapidly.

In the present invention, a short-time window (i.e., one that is wider in frequency) is used to locate where new words start, and a long-time window (i.e., one that is narrower in frequency) is used to track what happens during a word. The short-time filters enhance the effectiveness of the present invention by allowing the system to respond rapidly as the input signal changes. By using two separate pairs of filters— one for narrow frequency with relatively poor time resolution and the other for broad frequency with relatively good time resolution—the present invention obtains the optimal signal.

More specifically, the parallel short-time filters are used to obtain a rapid transition from the steady-state voiced speech segments to the adjacent fricatives or gaps in the speech without temporal smearing of the signal. The presence of a sudden change in the input signal is detected by the system, and the processing is switched to use the short-time (broad in frequency) filters so that the rapid change (e.g., a consonant at the start of a word) does not get missed. Once the signal appears to be in a more constant and steady-state segment, the system returns to using the long-time (tighter frequency resolution) filters to enhance the voiced features and reject any residual noise.

This approach provides a useful enhancement because the transitions from voiced to unvoiced speech, which can be discerned better with the short-time filters than the long-time filters, contribute to the intelligibility of the recovered speech signal. Moreover, the procedure for transient monitoring (i.e., detecting sudden changes in the input signal) and resolution switching (changing from the short-in-time but broad-in-frequency set of filters to the broad-in-time but narrow-in-frequency filters) has been used successfully in a wide variety of perceptual audio coders, such as MPEG-1, Layer 3 (MP3).

An example of the use of parallel filters is provided in Table 1. Using a signal sample frequency of 48,000 samples per second (48 kHz), a set of four time-length filters is created to observe the signal spectrum: 32 samples, 64 samples, 128 samples, and 2048 samples, corresponding to 667 microseconds, 1.33 milliseconds, 2.667 milliseconds, and 42.667 milliseconds, respectively. The shortest two durations correspond to the bar filter type, and the longer two durations correspond to the furrow filter type. Using a smoothly tapered time window function such as a hanning window ($w[n]=0.5-0.5\cos(2\pi n/M)$, $0 \leqq n \leqq M$ (total window length is M+1)), the fundamental frequency vs. time tradeoff yields frequency resolution as shown in Table 1 below, based on a normalized radian frequency resolution of $8\pi/M$ for the hanning window.

TABLE 1

| | Filter length (in samples) | Filter duration (seconds with 48 kHz sample rate) | Filter frequency resolution assuming hanning window (in Hz) |
|---|---|---|---|
| Short Bar | 32 | 0.000667 | 6193.548 |
| Long Bar | 64 | 0.001333 | 3047.619 |
| Short Furrow | 128 | 0.002667 | 1511.811 |
| Long Furrow | 2048 | 0.042667 | 93.7958 |

By way of comparison, a male talker with speech fundamental frequency 125 Hz corresponds to 8 ms (384 samples at 48 k Hz); therefore, the long furrow filter covers several fundamental periods and will resolve the individual partials. A female talker with speech fundamental frequency 280 Hz corresponds to 3.6 ms (171 samples at 48 k Hz), which is closer to the short furrow length. The bar filters are much shorter in time and will, therefore, detect spectral features that are short in duration as compared to the furrow filters. Although specific filter characteristics are provided in this example, many other tradeoffs are possible because the duration of the filter and its frequency resolution can be adjusted in a reciprocal manner (duration multiplied by bandwidth is a constant, due to the uncertainty principle).

Figure 7:
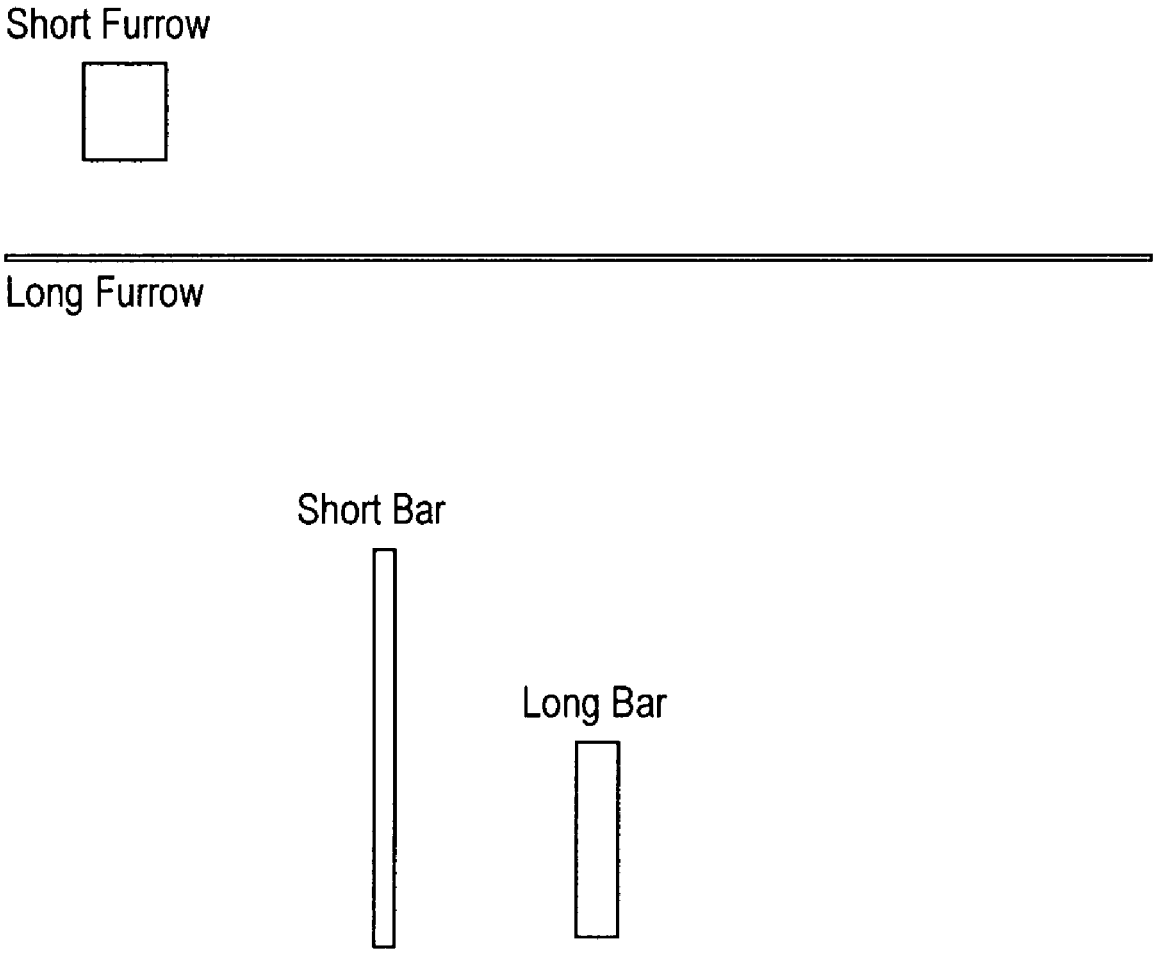
FIG. 7 is a graphic representation of the short and long furrow and bar filters of the present invention.

A graphic representation of the short and long furrow and bar filters expressed in Table 1 is shown in FIG. 7. The horizontal dimension corresponds to time and the vertical dimension corresponds to frequency.

C. Second Optional Enhancement: Improving Intelligibility by Monitoring the Temporal Relationship Between Voiced Segments and Fricative Segments The effectiveness of the furrow and bar filter concept may be enhanced in the context of typical audio signals such as speech by monitoring the temporal relationship between the voiced segments (furrow filter output) and the fricative segments (bar filter output) so that the fricative components are allowed primarily at boundaries between (i) intervals with no voiced signal present and (ii) intervals with voiced components. This temporal relationship is important because the intelligibility of speech is tied closely to the presence and audibility of prefix and suffix consonant phonemes. The behavior of the time-frequency filters includes some knowledge of the phonetic and expected fluctuations of natural speech, and these elementary rules are used to aid noise reduction while enhancing the characteristics of the speech.

D. Overview of the Present Invention

As described above, the present invention provides the means to distinguish between the coherent behavior of the desired signal components and the incoherent (uncorrelated) behavior of the additive noise. In the present invention, a time-variant spectral analysis of the incoming noisy signal is performed, features that behave consistently over a short-time window are identified, and features that exhibit random or inconsistent fluctuations are attenuated or removed. The major features of the present invention are:

(1) The present invention implements broadband noise reduction as a set of two-dimensional filters in the frequency vs. time domain. Rather than treating the noisy signal in the conventional way as an amplitude variation as a function of time (one dimension), this invention treats the noisy signal by observing how its frequency content (its spectrum) evolves with time. In other words, the behavior of the signal is observed as a function of two dimensions, time and frequency, instead of just as a function of time.

(2) The present invention uses a variety of time-frequency (2-D) filters with differing time and frequency resolutions in parallel to match the processing resolution to the time-variant signal characteristics. This means that the expected variations of the desired signal, such as human speech, can be retained and not unnecessarily distorted or smeared by the noise reduction processing.

(3) For speech signals, intelligibility is improved by explicitly estimating and treating the voiced-to-silence, voiced-to-unvoiced, unvoiced-to-voiced, and silence-to-voiced transitions. Because spoken words contain a sequence of phonemes that include these characteristic transitions, correctly estimating the typical transitions ensures that the system will not mistake the fricative phonemes of the desired speech as undesired additive noise.

Thus, the present invention entails a data-adaptive multi-dimensional (amplitude vs. frequency and time) filter structure that works to enhance spectral components that are narrow in frequency but relatively long in time (coherent), while reducing signal components that exhibit neither frequency nor temporal correlation (incoherent) and are therefore most likely to be the undesired additive noise.

The present invention detects the transition from a coherent segment of the signal to an incoherent segment, assesses the likelihood that the start of the incoherent segment is due to a fricative speech sound, and either allows the incoherent energy to pass to the output if it is attributed to speech, or minimizes the incoherent segment if it is attributed to noise. The effectiveness of this approach is due to its ability to pass the quasi-harmonic characteristics and the short-in-time but broad-in-frequency content of fricative sounds found in typical signals such as speech and music, as opposed to the uncorrelated time-frequency behavior of the broadband noise. An example of the time-frequency behavior of a noisy speech signal is depicted in FIG. 8.

Figure 8:
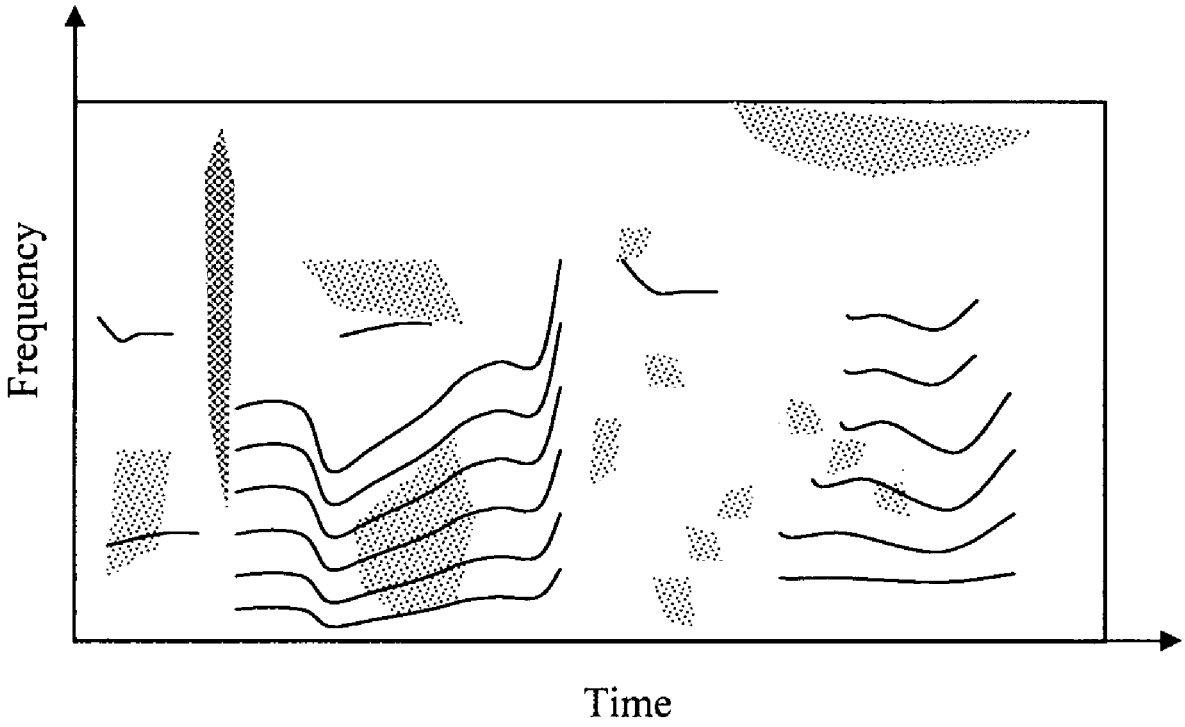
FIG. 8 is a diagram of noisy speech displayed as a frequency vs. time spectrogram.
Figure 9:
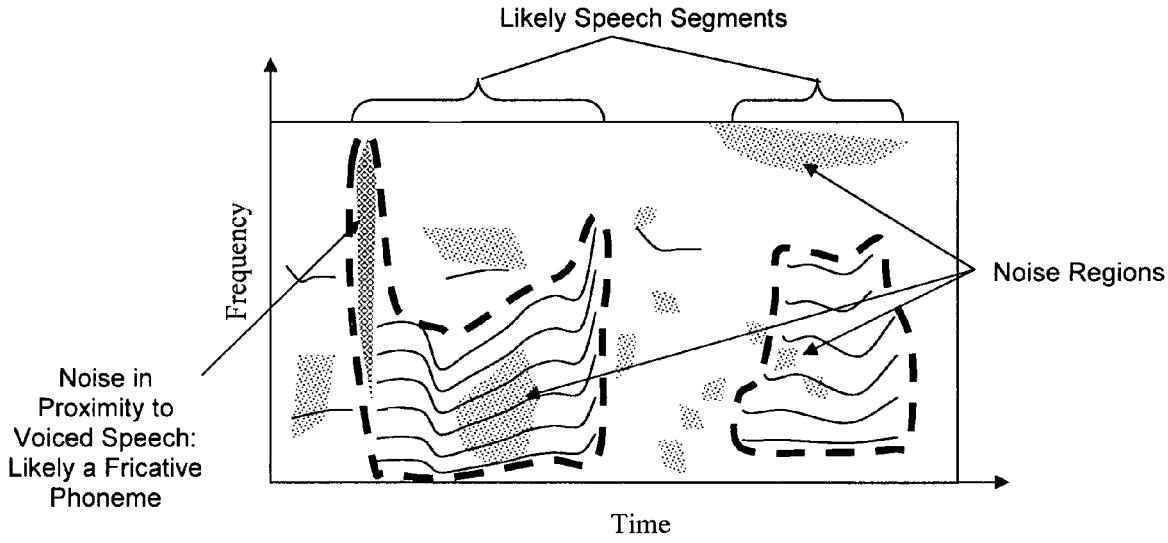
FIG. 9 is a diagram of the noisy speech of FIG. 7 with likely speech and noise segments identified.

Several notable and typical features are shown in FIG. 8. The time segments with sets of parallel curves, or tracks, indicate the presence of voiced speech. The vertical spacing of the tracks varies with time, but all the tracks are equally spaced, indicating that they are harmonics (overtones) of a fundamental frequency. The signal shown in FIG. 8 also contains many less distinct concentrations of energy that do not show the coherent behavior of the voiced speech. Some are short tracks that do not appear in harmonic groups, while others are less concentrated incoherent smudges. These regions in the frequency vs. time representation of the signal are likely to be undesired noise because they appear uncorrelated in time and frequency with each other; however, there is a segment of noise that is narrow in time but broad in frequency that is also closely aligned with the start of a coherent segment. Because sequences of speech phonemes often include fricative-to-voiced transitions, it is likely that the alignment of the narrow-in-time and broad-in-frequency noise segment is actually a fricative sound from the desired speech. This identification is shown in FIG. 9.

Figure 10:
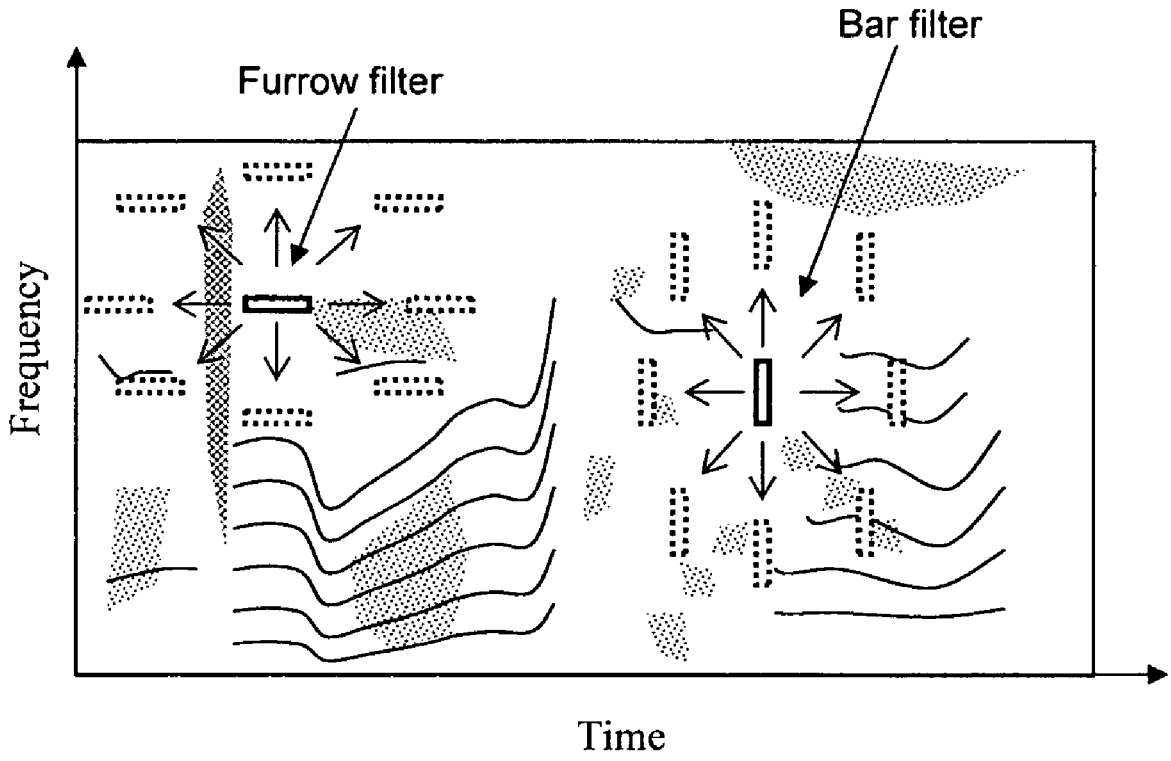
FIG. 10 is a diagram of the two-dimensional filter concept of the present invention superimposed on the spectrogram of FIG. 7.

As discussed above, the present invention utilizes two separate 2-D filters. The furrow filter preferentially selects spectral components that are narrow in frequency but relatively broad in time (corresponding to discrete spectral partials, as found in voiced speech and other quasi-periodic signals), while the bar filter passes spectral components that are broad in frequency but relatively narrow in time (corresponding to plosive and fricative consonants found in speech signals). This 2-D filter arrangement is depicted in FIG. 10. Although the furrow and bar filters are shown as pure rectangles in FIGS. 10, 6 and 7, the actual filters are shaped with a smoothing window to taper and overlap the time-frequency response functions.

Figure 11:
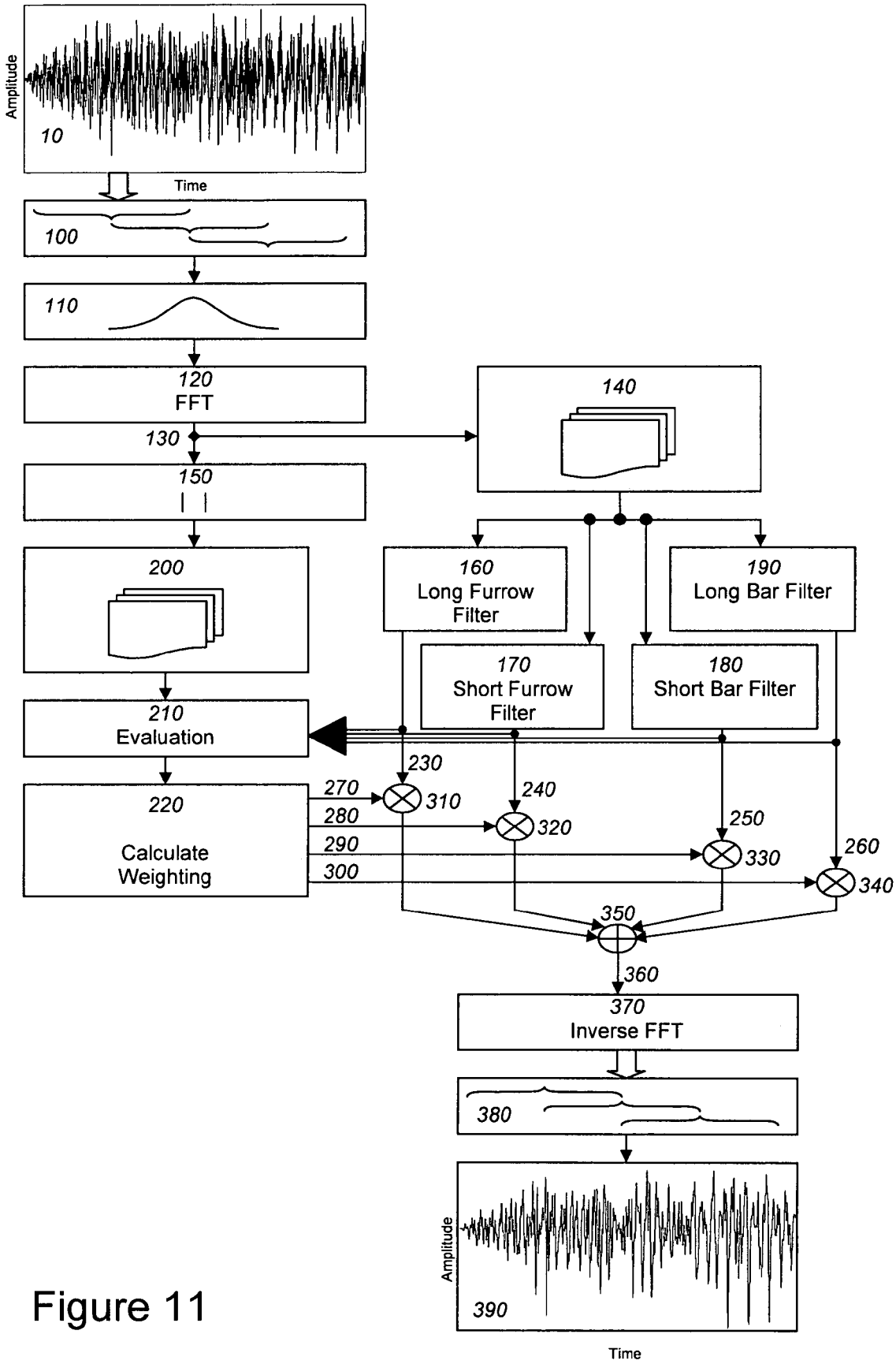
FIG. 11 is a flow diagram illustrating to two-dimensional enhancement filter concept the present invention.

FIG. 11 illustrates a preferred method of implementing the noise reduction system of the present invention. The noisy input signal 10 is segmented into overlapping blocks 100. The block length may be fixed or variable, but in this case a fixed block length is shown for clarity. The overlap between blocks is chosen so that the signal can be reconstructed by overlap-adding the blocks following the noise reduction process. A 50% or more overlap is appropriate. The block length is chosen to be sufficiently short that the signal within the block length can be assumed to be stationary, while at the same time being sufficiently long to provide good resolution of the spectral structure of the signal. With speech signals, a block length corresponding to 20 milliseconds is appropriate, and the block length is generally chosen to be a power of 2 so that a radix-2 fast Fourier transform algorithm can be used, as described below.

For each block, the data is multiplied by a suitable smoothly tapered window function 110 to avoid the truncation effects of an abrupt (rectangular) window, and passed through a fast Fourier transform ("FFT") 120. The FFT computes the complex discrete Fourier transform of each windowed data block. The FFT length can be equal to the block length, or optionally the windowed data can be zero-padded to a longer block length if more spectral samples are desired.

The blocks of raw FFT data 130 are stored in queue 140 containing the current and a plurality of past FFT blocks. The queue is a time-ordered sequence of FFT blocks that is used in the two-dimensional furrow and bar filtering process, as described below. The number of blocks stored in queue 140 is chosen to be sufficiently long for the two-dimensional furrow and bar filtering, Simultaneously, the FFT data blocks 130 are sent through magnitude computation 150, which entails computing the magnitude of each complex FFT sample. The FFT magnitude blocks are stored in queue 200 and form a sequence of spectral "snapshots," ordered in time, with the spectral information of each FFT magnitude block forming the dependent variable.

The two-dimensional (complex FFT spectra vs. time) raw data in queue 140 is processed by the two-dimensional filters 160 (long furrow), 170 (short furrow), 180 (short bar), and 190 (long bar), yielding filtered two-dimensional data 230, 240, 250, and 260, respectively.

Evaluation block 210 processes the FFT magnitude data from queue 200 and the filtered two-dimensional data 230, 240, 250, and 260, to determine the current condition of the input signal. In the case of speech input, the evaluation includes an estimate of whether the input signal contains voiced or unvoiced (fricative), whether the signal is in the steady-state or undergoing a transition from voiced to unvoiced or from unvoiced to voiced, whether the signal shows a transition to or from a noise-only segment, and similar calculations that interpret the input signal conditions. For example, a steady-state voiced speech condition could be indicated by harmonics in the FFT magnitude data 200 and more signal power present in the long furrow filter output 230 than in the short bar filter output 250.

The evaluation results are used in the filter weighting calculation 220 to generate mixing control weights 270, 280, 290, and 300, which are each scalar quantities between zero and one. The control weights 270, 280, 290, and 300 are sent to multipliers 310, 320, 330, and 340, respectively, to adjust the proportion of the two-dimensional output data 230, 240, 250, and 260 that are additively combined in summer 350 to create the composite filtered output FFT data 360. The control weights select a mixture of the four filtered versions of the signal data such that the proper signal characteristics are recovered from the noisy signal. The control weights 270, 280, 290, and 300 are calculated such that their sum is equal to or less than one. If the evaluation block 210 detects a transition from one signal state to another, the control weights are switched in smooth steps to avoid abrupt discontinuities in the output signal.

The composite filtered output FFT data blocks 360 are sent through inverse FFT block 370, and the resulting inverse FFT blocks are overlapped and added in block 380, thereby creating the noise-reduced output signal 390.

Figure 12:
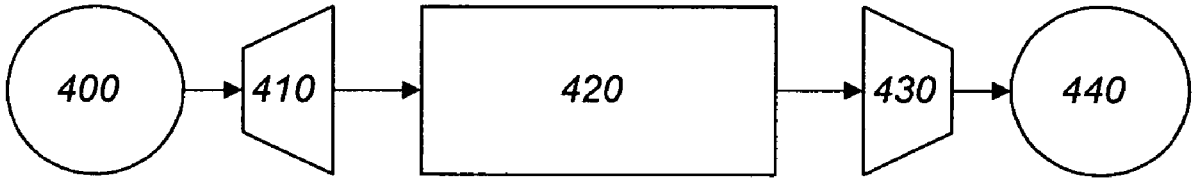
FIG. 12 is a flow diagram of the overall process in which the present invention is used.

FIG. 12 provides further context for the present invention by illustrating the overall process in which the present invention is used. An analog signal source 400 is converted by an analog-to-digital converter ("ADC") 410 to a data stream where each sample of data represents a measured point in the analog signal. Next, a digital signal processor ("DSP") or microprocessor ("MPU") 420 is used to process the digital data stream from the ADC 410. The DSP or MPU 420 applies the method of the present invention to the data stream. Once the data is processed, the DSP or MPU 420 delivers the data stream to the digital-to-analog converter ("DAC") 430, which converts the incoming digital data stream to an analog signal where each sample of data represents a measured point in the analog signal. The DAC 430 must be matched to the ADC 410 to encode the original analog signal, just as the ADC 410 must be matched to the DAC 430 to decode the analog signal. The end result of this process is a noise-reduced analog signal 440.

Despite the fact that the above discussion focuses on the reduction or elimination of noise from analog signals, the present invention can also be applied to a signal that has already been digitized (like a .wav or .aiff file of a music recording that happens to contain noise). In that case, it is not necessary to perform the analog-to-digital conversion. Because the processing of the present invention is performed on a digitized signal, the present invention is not dependent on an analog-to-digital conversion.

E. Practical Applications

In contrast to the prior art methods for noise reduction and signal enhancement, the filter technology of the present invention effectively removes broadband noise (or static) from analog signals while maintaining as much of the desired signal as possible. The present invention can be used in connection with AM radio, particularly for talk radio and sports radio, and especially in moving vehicles or elsewhere when the received signal is of low or variable quality. The present invention can also be applied in connection with shortwave radio, broadcast analog television audio, cell phones, and headsets used in high-noise environments like tactical applications, aviation, fire and rescue, police and manufacturing.

The problem of a low signal-to-noise ratio is particularly acute in the area of AM radio. Analog radio broadcasting uses two principal methods: amplitude modulation (AM) and frequency modulation (FM). Both techniques take the audio signal (speech, music, etc.) and shift its frequency content from the audible frequency range (0 to 20 kHz) to a much higher frequency that can be transmitted efficiently as an electromagnetic wave using a power transmitter and antenna. The radio receiver reverses the process and shifts the high frequency radio signal back down to the audible frequency range so that the listener can hear it. By assigning each different radio station to a separate channel (non-overlapping high frequency range), it is possible to have many stations broadcasting simultaneously. The radio receiver can select the desired channel by tuning to the assigned frequency range.

Amplitude modulation (AM) means that the radio wave power at the transmitter is rapidly made larger and smaller ("modulated") in proportion to the audio signal being transmitted. The amplitude of the radio wave conveys the audio program; therefore, the receiver can be a very simple radio frequency envelope detector. The fact that the instantaneous amplitude of the radio wave represents the audio signal means that any unavoidable electromagnetic noise or interference that enters the radio receiver causes an error (audible noise) in the received audio signal. Electromagnetic noise may be caused by lightning or by a variety of electrical components such as computers, power lines, and automobile electrical systems. This problem is especially noticeable when the receiver is located in an area far from the transmitter because the received signal will often be relatively weak compared to the ambient electromagnetic noise, thus creating a low signal-to-noise-ratio condition.

Frequency modulation (FM) means that the instantaneous frequency of the radio wave is rapidly shifted higher and lower in proportion to the audio signal to be transmitted. The frequency deviation of the radio signal conveys the audio program. Unlike AM, the FM broadcast signal amplitude is relatively constant while transmitting, and the receiver is able to recover the desired frequency variations while effectively ignoring the amplitude fluctuations due to electromagnetic noise and interference. Thus, FM broadcast receivers generally have less audible noise than AM radio receivers.

It should be clear to those skilled in the art of digital signal processing that there are many similar methods and processing rule modifications that can be envisaged without altering the key concept of this invention, namely, the use of a 2-D filter model to separate and enhance the desired signal components from those of the noise. Although a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

DEFINITIONS

The term "amplitude" means the maximum absolute value attained by the disturbance of a wave or by any quantity that varies periodically. In the context of audio signals, the term "amplitude" is associated with volume.

The term "demodulate" means to recover the modulating wave from a modulated carrier.

The term "frequency" means the number of cycles completed by a periodic quantity in a unit time. In the context of audio signals, the term "frequency" is associated with pitch.

The term "fricative" means a primary type of speech sound of the major languages that is produced by a partial constriction along the vocal tract which results in turbulence; for example, the fricatives in English may be illustrated by the initial and final consonants in the words vase, this, faith and hash.

The term "hertz" means a unit of frequency or cycle per second.

The term "Hz" is an abbreviation for "hertz."

The term "kHz" is an abbreviation for "kilohertz."

The term "modulate" means to vary the amplitude, frequency, or phase of a wave, or vary the velocity of the electrons in an electron beam in some characteristic manner.

The term "modulated carrier" means a radio-frequency carrier wave whose amplitude, phase, or frequency has been varied according to the intelligence to be conveyed.

The term "phoneme" means a speech sound that is contrastive, that is, perceived as being different from all other speech sounds.

The term "plosive" means a primary type of speech sound of the major languages that is characterized by the complete interception of airflow at one or more places along the vocal tract. For example, the English words par, bar, tar, and car begin with plosives.

REFERENCES

Boll, Steven F. "Suppression of acoustic noise in speech using spectral subtraction." *IEEE Transactions on Acoustics, Speech, and Signal Processing*. Vol. ASSP-27, No. 2. April 1979: 113-20.

Kahrs, Mark and Brandenburg, Karlheinz, eds. *Applications of Digital Signal Processing to Audio and Acoustics*. Norwell, Mass.: Kluwer Academic Publishers Group, 1998.

Lim, Jae S. and Oppenheim, Alan V. "Enhancement and Bandwidth Compression of Noisy Speech." *Proceedings of the IEEE*. Vol. 67, No. 12. December 1979: 1586-1604.

Maher, Robert C. "A Method for Extrapolation of Missing Digital Audio Data." *J. Audio Eng. Soc.* Vol. 42, No. 5. May 1994: 350-57.

Maher, Robert C. "Digital Methods for Noise Removal and Quality Enhancement of Audio Signals." Seminar presentation, Creative Advanced Technology Center, Scotts Valley, Calif. April 2002.

McAulay, Robert J. and Malpass, Marilyn L. "Speech Enhancement Using a Soft-Decision Noise Suppression Filter." *IEEE Transactions on Acoustics, Speech, and Signal Processing*. Vol. ASSP-28, No. 2. April 1980: 137-45.

Moorer, James A. and Berger, Mark. "Linear-Phase Band-splitting: Theory and Applications." *J. Audio Eng. Soc*. Vol. 34, No. 3. March 1986: 143-52.

Rabiner, L. R. and Schafer, R. W. *Digital Processing of Speech Signals*. Englewood Cliffs, N.J.: Prentice-Hall, Inc., 1978.

Ramarapu, Pavan K. and Maher, Robert C. "Methods for Reducing Audible Artifacts in a Wavelet-Based Broad-Band Denoising System." *J. Audio Eng. Soc*. Vol. 46, No. 3. March 1998: 178-189.

Weiss, Mark R. and Aschkenasy, Ernest. "Wideband Speech Enhancement (Addition)." Final Tech. Rep. RADC-TR-81-53, DTIC ADA100462. May 1981.

We claim:

1. A method of reducing noise in an audio signal, wherein the audio signal comprises spectral components, comprising the steps of:

(a) using a furrow filter to select spectral components that are narrow in frequency but relatively broad in time;

(b) using a bar filter to select spectral components that are broad in frequency but relatively narrow in time;

(c) wherein there is a relative energy distribution between the output of the furrow and bar filters, analyzing the relative energy distribution between the output of the furrow and bar filters to determine the proportion of spectral components selected by each filter that will be included in an output signal;

(d) reconstructing, using a processor, the audio signal based on the analysis in step (c) above to generate the output signal;

(e) wherein the furrow and bar filters are referred to as the first pair of time-frequency filters, using a second pair of time-frequency filters to improve intelligibility of the output signal; and (f) wherein the audio signal comprises fricative components, wherein the second pair of time-frequency filters comprises a furrow filter and a bar filter, wherein there is a temporal relationship between the output of the furrow filters of the first and second pairs of time-frequency filters and the output of the bar filters of the first and second pairs of time-frequency filters, monitoring the temporal relationship between the furrow filter output and the bar filter output so that the fricative components are allowed at boundaries between intervals with no voiced signal present and intervals with voice components.

2. A noise reduction system for an audio signal, wherein the audio signal comprises spectral components, comprising:

a processor;

(a) a furrow filter; and (b) a bar filter;

wherein the furrow filter is used to select spectral components that are narrow in frequency but relatively broad in time, and the bar filter is used to select spectral components that are broad in frequency but relatively narrow in time;

wherein there is a relative energy distribution between the output of the furrow and bar filters, and said relative energy distribution is analyzed to determine the proportion of spectral components selected by each filter that will be included in an output signal;

wherein, using the processor, the audio signal is reconstructed based on the analysis of the relative energy distribution between the output of the furrow and bar filters to generate the output signal;

wherein the furrow and bar filters are referred to as the first pair of time-frequency filters, further comprising a second pair of time-frequency filters, wherein the second pair of time-frequency fitters is used to improve intelligibility of the output signal;

wherein the audio signal comprises fricative components;

wherein the second pair of time-frequency filters comprises a furrow filter and a bar filter;

wherein there is a temporal relationship between the output of the furrow filters of the first and second pairs of time-frequency filters and the output of the bar filters of the first and second pairs of time-frequency filters; and wherein the temporal relationship between the furrow filter output and the bar filter output is monitored so that the fricative components are allowed at boundaries between intervals with no voiced signal present and intervals with voice components.

* * * * *